US008920265B1

(12) United States Patent
Jones

(10) Patent No.: US 8,920,265 B1
(45) Date of Patent: Dec. 30, 2014

(54) BALLMARK REPAIR TOOL AND METHODS

(71) Applicant: Paul W. Jones, Greensboro, NC (US)

(72) Inventor: Paul W. Jones, Greensboro, NC (US)

( * ) Notice: Subject to any disclaimer, the term of this patent is extended or adjusted under 35 U.S.C. 154(b) by 0 days.

(21) Appl. No.: 13/752,715

(22) Filed: Jan. 29, 2013

Related U.S. Application Data

(60) Provisional application No. 61/723,451, filed on Nov. 7, 2012.

(51) Int. Cl.
*A63B 57/00* (2006.01)

(52) U.S. Cl.
CPC ..... *A63B 57/0068* (2013.01)
USPC ..... 473/408

(58) Field of Classification Search
USPC ..... 473/408, 286; D21/793; 172/13, 40, 172/371, 373, 378, 379
See application file for complete search history.

(56) References Cited

U.S. PATENT DOCUMENTS

| | | | | | |
|---|---|---|---|---|---|
| 2,774,292 | A | * | 12/1956 | Hartmann | 172/40 |
| 2,869,915 | A | * | 1/1959 | Good | 294/50.6 |
| 3,369,431 | A | * | 2/1968 | Srsen | 81/52 |
| 3,567,264 | A | * | 3/1971 | Baber | 294/50.7 |
| 4,179,147 | A | * | 12/1979 | Mendenhall | 294/50.7 |
| 4,213,504 | A | * | 7/1980 | Schneider | 172/25 |
| 4,726,427 | A | * | 2/1988 | Steiner | 172/41 |
| 4,846,286 | A | * | 7/1989 | McNeely et al. | 172/379 |
| 5,322,130 | A | | 6/1994 | Ryden | 172/378 |
| 5,398,927 | A | * | 3/1995 | O'Sullivan | 473/176 |
| 5,730,266 | A | | 3/1998 | Kajitani | 172/378 |
| 5,865,259 | A | * | 2/1999 | Catto | 172/25 |
| 6,062,992 | A | | 5/2000 | Hoyt et al. | 473/408 |
| 6,244,356 | B1 | * | 6/2001 | Luna | 172/381 |
| D452,544 | S | | 12/2001 | Bato | D21/793 |
| 6,340,061 | B2 | * | 1/2002 | Marshall et al. | 172/41 |
| 7,140,983 | B2 | * | 11/2006 | Pietsch | 473/408 |
| D582,734 | S | * | 12/2008 | Murray et al. | D8/8 |
| 8,348,787 | B2 | | 1/2013 | Halsey et al. | 473/408 |
| 8,613,326 | B2 | * | 12/2013 | Pare et al. | 172/41 |
| 2004/0048694 | A1 | * | 3/2004 | Swensen et al. | 473/408 |
| 2004/0219997 | A1 | * | 11/2004 | Champion | 473/408 |
| 2009/0181808 | A1 | * | 7/2009 | Tate | 473/408 |
| 2012/0040779 | A1 | * | 2/2012 | Lindh | 473/408 |
| 2013/0065710 | A1 | * | 3/2013 | Schaaf | 473/408 |

OTHER PUBLICATIONS

About.com; How to Repair Ball Marks; article from the Internet as of Jul. 31, 2012.
TJB Green-Saver Ball Mark Repair Tool; information from the Internet as of Aug. 22, 2012.

* cited by examiner

*Primary Examiner* — Steven Wong
(74) *Attorney, Agent, or Firm* — MacCord Mason PLLC

(57) ABSTRACT

A ballmark repair tool. In one embodiment, the device comprises a handle assembly to allow the user to stand upright when repairing a ballmark on a putting green and a twistable prong assembly. The twistable prong assemble may include a plurality of planetary gears and a pinion gear that is engaged with the planetary gears. The result is a device and method of repairing a putting green that allows uniform and properly repaired ballmarks.

17 Claims, 5 Drawing Sheets

BALLMARK REPAIR TOOL AND METHODS

RELATED APPLICATIONS

This application claims priority to U.S. provisional application 61/723,451, filed Nov. 7, 2012, which is incorporated herein by reference in its entirety.

BACKGROUND

1. Field

The present inventions relate generally to golf equipment and, more particularly, to improved ballmark tools and methods of repairing ballmarks on a putting green.

2. Related Art

Golf shots from lofted clubs, and the like, to a putting green often result in ballmarks, or similar pitch marks on a putting green's surface. Ballmarks are golf-ball sized depressions on the surface of the putting green that are embedded when the golf ball descends and impacts the putting surface. Proper repair of these ballmarks maintains the integrity of healthy putting surfaces, and minimizes scaring and other concerns associated with green damage. For instance, unless repaired properly, the ballmark will deflect the path of the ball of any subsequent golfer whose ball crosses the mark.

Therefore, a divot tool is used to repair the ballmarks on the surface of the putting green. Traditionally, the divot tool is a hand-held device that includes two blades at the end of a piece of metal or hardened plastic. To repair a ballmark with the traditional tool, the golfer, or maintenance personnel, must bend over to the surface of the green. The prongs of the repair tool are inserted into turf around the depression. Then, using the tool, the user guides the edge of the ballmark toward the center of the depression. Thus, traditional methods include pinching the sides of the ballmark toward the center of the depression.

This traditional ballmark repair method may easily be incorrectly performed, resulting in improper green prepare, and even tearing of roots and eventual destruction of the grass. For instance, many golfers insert the tool at an angle, so that the prongs are beneath the center of the depression, and then use the tool as a lever to push the bottom of the ballmark upward to flush with the green surface. Further, existing tools require hand/eye judgment as to where to insert the prongs of the spade. Still further, existing tools require subjective judgment as to how many times/places to have the prongs enter the green turf around the ballmark. Still further, existing tools require subjective judgment as to where to lift and turn the green turf for optimum repair. As such, the uncertainties and subjective judgment required by traditional tools easily lend to incorrect and damaging results.

Therefore, there is a need for systems and methods for a gentle twisting motion for uniform ballmark repair while, at the same time, may be performed with minimum training and without the drawbacks presented by the traditional systems and methods.

SUMMARY

In accordance with the present inventions, a ballmark repair tool is provided for repairing ballmarks on a putting green. These inventions provide an improved repair tool that is convenient, efficient and safe for the user, particularly when used to repair ballmarks and the like from a standing position.

One aspect of the present inventions is to provide a twist assembly for a ballmark repair tool that comprises a handle and prong assembly. The twist assembly includes a plurality of planetary gears and a pinion gear that is generally engaged with the planetary gears. The plurality of planetary gears may include four planetary gears that are surrounding the pinion gear. A setscrew may secure each of the plurality of planetary gears.

Typically, a housing is included to house the plurality of planetary gears and pinion gears, for instance from moving components, as well as avoiding mechanical failure from dirt, debris and the like. The housing may include a top opening and a cavity. The housing may include a plurality of prong apertures that are generally adapted to receive the prong assembly. The prong apertures may receive prong extensions. Further, the housing may include a top cover. Fasteners may be used to secure the top cover.

In some examples, a pinion gear is centered about the plurality of planetary gears. A coupling may be used to engage the pinion gear. The coupling may be adapted to couple the rotation of the turning portion and the prong assembly. For instance, the coupling may be adapted to couple the rotation of the turning portion and the prong assembly in a single motion. A setscrew may be used to secure the coupling.

Another aspect of the present inventions is to provide a ballmark repair tool for repairing a ballmark on a putting green having a handle assembly and a twistable prong assembly. Typically, the handle assembly includes a turning portion that is positioned on a proximate end of an elongated body. The twistable prong assembly is typically positioned on a distal end of the elongated body and is in communication with the turning portion. The twistable prong assemble may be adapted to twist substantially ninety degrees.

In some examples, the ballmark repair tool includes a plurality of ground-engaging blade units. The blade units typically remain perpendicular to the ballmark during twisting. The blade units may include a proximate blade and a distal blade. Further, a linkage may be positioned between the proximate blade and the distal blade. The proximate blade may include a face adapted to rotate substantially ninety degrees. The distal blade is generally adapted to transverse substantially ninety degrees, for instance across the twistable prong assembly. The blade units may include prong extensions that are generally received by the twistable prong assembly. Typically, the blade units include rigid ends adapted to protrude through the putting green.

In yet other examples, the elongated body is about thirty inches in length to allow a user to remain standing during ballmark repair. Further, the turning portion may include opposing bars. For instance, the opposing bars may be spatially separated from the elongated body. The turning portion may include a handgrip. The turning portion may be substantially perpendicular to the twistable prong assembly. The turning portion may include a knob. The turning portion may be adapted to twist the prong assembly substantially ninety degrees in a single motion. The elongated body may include threaded opposing ends. The elongated body may include an aperture that is adapted to receive a setscrew. The elongated body may include an outer sleeve. The sleeve may include a cavity adapted to receive the body. Further, the sleeve may include a threaded lower end adapted to engage the prong assembly.

Yet another aspect of the inventions is to provide ballmark repair tool for repairing a ballmark on a putting green comprising a handle assembly, a twistable prong assembly and a plurality of ground-engaging blade units. Typically, the handle assembly has a turning portion that is generally positioned on a proximate end of an elongated body. The twistable prong assembly is typically positioned on a distal end of the elongated body. Further, the twistable prong assembly is typically in communication with the turning portion. The twistable prong assemble may include a plurality of planetary gears and a pinion gear engaged with the planetary gears.

The above summary was intended to summarize certain embodiments of the present inventions. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the inventions will be better understood by a reading of the Description of Embodiments along with a review of the drawings, in which.

DESCRIPTION OF EMBODIMENTS

Figure 1:
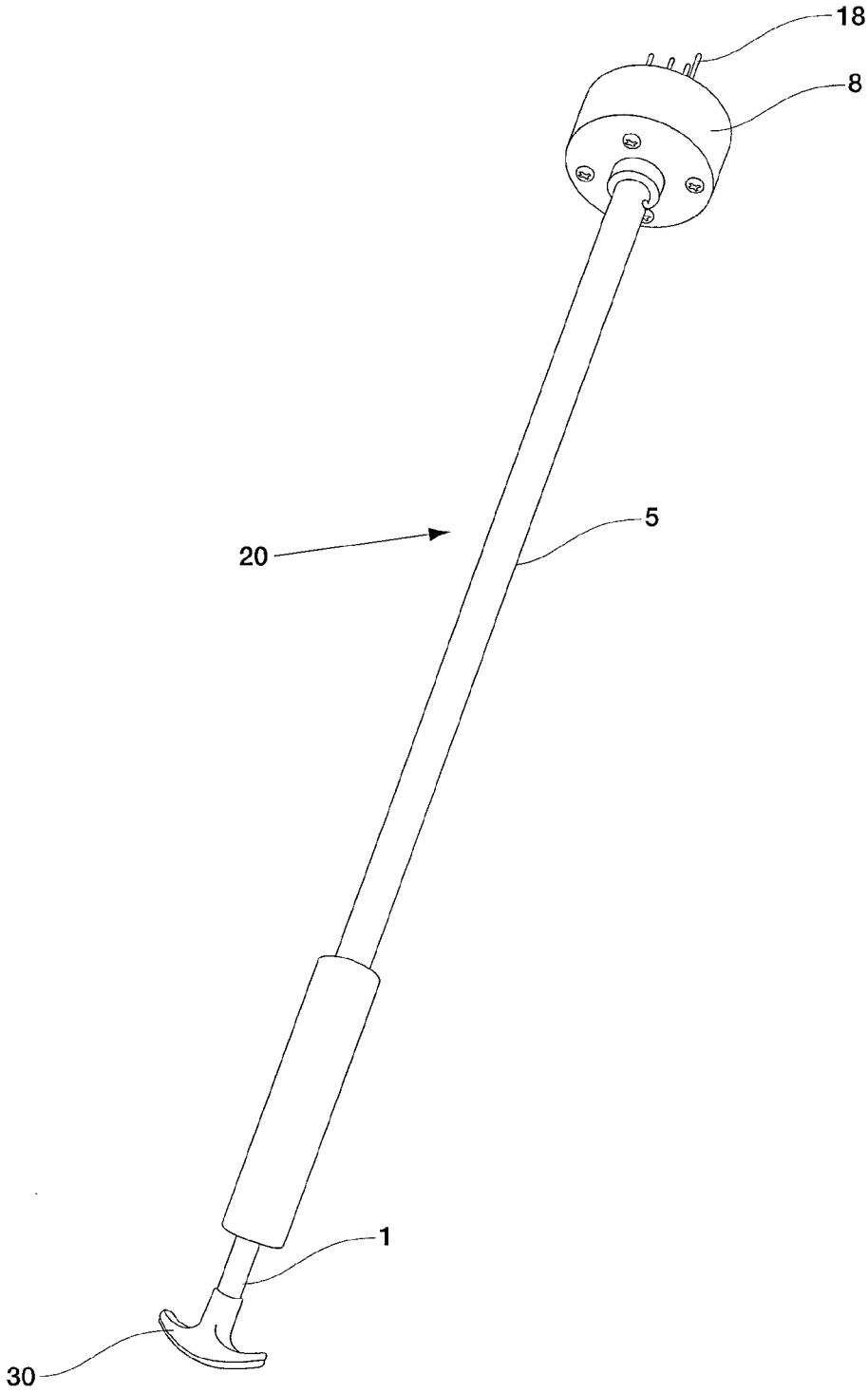
FIG. 1 is a side, perspective view of a ballmark repair tool constructed according to an embodiment of the inventions.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing embodiments of the inventions and are not intended to limit the disclosure or any inventions thereto. As best seen in FIG. 1, a ballmark repair tool 20 is shown embodied according to the present inventions. The ballmark repair tool 20 includes a twistable prong assembly that is spatially separated from the handle assembly 30. As shown, the twistable prong assembly includes a plurality of blade units 18 that protrude into the green and twist substantially ninety degrees to repair a ballmark.

As shown in FIG. 1, the ballmark repair tool is configured for inserting the prong assembly into the green and twisting the blade units 18 to repair the ballmark or the like. Typically, an elongated body 1 is the main shaft that separates the handle assembly 30 and the twistable prong assembly, so that the user may remain standing to repair the green or the like. For instance, the elongated body 1 may be a shaft of about one-half inches in diameter and about twenty to about forty inches, including about thirty inches in length. In particular examples, the elongated body 1 and/or a sleeve 5 translate rotation of the handle assembly 30 to the prong assembly. Further, the sleeve 5 typically secures the housing 8 of the prong assembly and the handle assembly 30.

Figure 2:
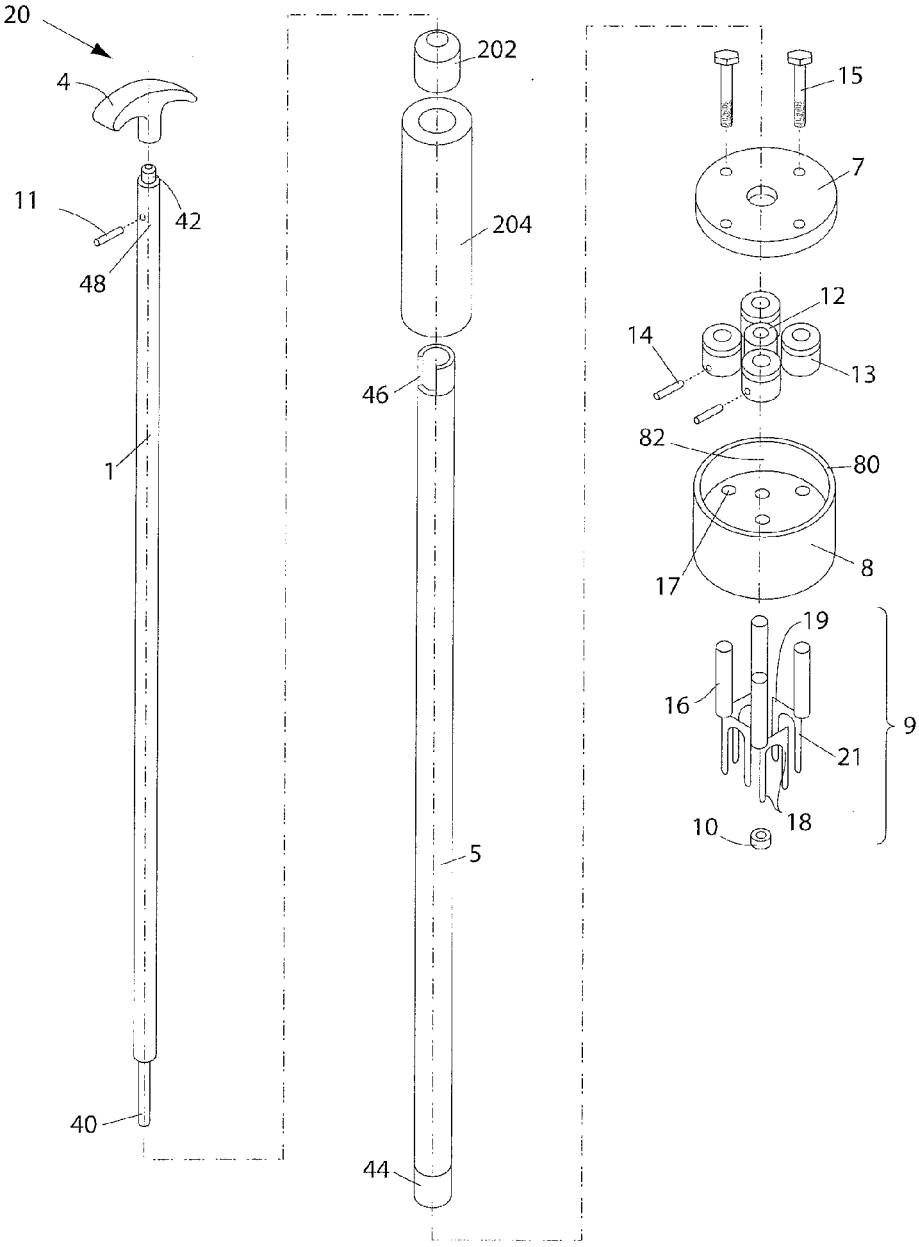
FIG. 2 is an exploded, side-perspective view of the embodiment of FIG. 1.

FIG. 2 illustrates one particular embodiment of a ballmark repair tool for a single-motion repair. The prong assembly 9 is generally sized to fit the boundary of a golf-ball sized ballmark on a putting green. For instance, the periphery of the prong assembly 9 between the blade units 18 may be about a quarter inch larger than a golf ball. The prong assembly 9 includes a plurality of twistable blade units 18 protruding through housing 8. As shown, there are four blade units extending from the prong support 19 perpendicular to the prong assembly 9 in the first entry position and also throughout the twisting motion discussed hereinafter. The blade units 18 can be constructed of a variety of shapes, styles and sizes for the convenience of its user, including for exemplary purposes only, hard plastics and metals, including aluminum. Typically, the blade units 18 include rigid and/or sharp distal ends to protrude through the surface of the green to facilitate a clean turning action against the resistance and friction of the turf in the putting green.

As shown in FIG. 2, the top portion of the blade units 18 have prong extensions 16 spanning above the prong support 19. Typically, the prong support 19 is a planar face and maintains the blade units 18 in alignment with one another, e.g. supports and/or connects the linkages 21 of each blade unit 18. Therefore, the prong extensions 16 may extend above the prong support 19 and generally protrude through the housing and to mate with a particular planetary gear 13. Typically, the prong extensions 16 protrude through the prong apertures 17 of the lower portion of the housing 8. Other examples include a variety of aperture and housing arrangements to position the prong assembly relative to the gear assembly.

Each blade unit 18 typically includes two blade prongs separated by a linkage 21. As shown in FIG. 2, the linkage 21 spanning between the blade prongs of each blade unit 18 is a substantially horizontal element; however, other examples include a variety of linkage shapes and configurations. Linkage 21 is constructed from a variety of materials, including but not limited to metals and hardened plastics, which are substantially rigid to support blade unit rotation and maintain the connection with the prong assembly 9.

As seen in FIG. 2, the housing 8 is generally sized to protect the prong assembly 9 and gears during mechanical movements and from dirt/debris during use. The housing 8 may include a top cover 7 that is generally aligned and secured to the housing 8 with fasteners 15. Typically, the top cover 7 includes holes through which the fasteners 15 may protrude to connect to housing 8. In some examples, the fasteners 15 are head screws.

The prong assembly 9 is generally twistable, for instance the blade units 18 may twist substantially ninety degrees of rotation. For instance, the blade units 18 illustrated in FIG. 2 include one prong that is twistable substantially ninety degrees of rotation across the face of the prong support 19 as discussed hereinafter. However, in other examples, the prong assembly is twistable in less than ninety degrees, as well as twistable in directions greater than ninety degrees to meet a particular ballmark repair application.

The twist assembly may include a plurality of planetary gears 13 surrounding a pinion gear 12. Typically, the pinion gear 12 engages each of the planetary gears 13, which in turn drive the rotation of the prong assembly 9. In particular examples, each planetary gear 13 is generally associated with a blade unit 18, and each planetary gear is sized to fit within housing 8. Typically, the planetary gears 13 are secured in place with setscrews 14. FIG. 2 illustrates an embodiment having four planetary gears 13 circumferentially surrounding the pinion gear 12. The teeth of the planetary gears 13 engage the teeth of the pinion gear 12. Other examples include a variety of planetary gears 13 in engagement of the pinion gear 12 to twist the prong assembly 9.

Thus, the rotation of the turning portion 2 is translated downward through the elongated body assembly to the pinion gear 12. The pinion gear 12 rotates and its threads engage the surrounding planetary gears 13. As a result, the planetary gears rotate about the pinion gear 12 to twist the twist assembly 9. The blade units 18 are affixed to the planetary gears 13, so the blade units thereby twist substantially ninety degrees through the turf surrounding the ballmark. A fastener nut 10 may secure the lower portion of the prong assembly 9.

In one example, the elongated body 1 generally protrudes through the sleeve 5 and gear assembly and is secured by a fastener on the distal end. A knob 4, handle or the like may be secured on the proximate end of the elongated body 1. FIG. 2 illustrates that the elongated body 1 may include a pair of opposed threaded ends. For instance, the elongated body 1 may include a threaded upper end 42 and a threaded lower end 40. The threaded upper end 42 may include male threads that threadably engage the knob 4 or other handle mechanism to activate the twisting motion. In some examples, the knob 4 allows a user to impart substantially ninety degree twisting to the prong assembly in a single motion, i.e. a single hand motion. Further, the opposing end of the elongated body 1 may similarly have a threaded lower end 40. The threaded lower end 40 may include male threads that generally protrude through housing 8 and the pinion gear 12 and are retained by a fastener. The fastener may be a fastener nut 10. Other embodiments of the elongated body include a lower end 40 that is generally affixed to the prong assembly in a variety of arrangements to transfer the rotation of the turning portion to the prong assembly.

As illustrated in FIG. 2, the sleeve 5 is a generally cylindrical body and is placed outside of the elongated main shaft. In some examples, the sleeve is constructed of PVC or a like material, for instance a material that would not damage the grooves or other portions of a golf club if rubbed against the club in the golf bag of the like. The the proximate end 46 and the distal end 44 of sleeve 5 may include a threaded portion for securing various elements of the repair tool discussed herein. For instance, the proximate end 46 of the sleeve may include female threads. Similarly, the distal end 44 of the sleeve may include female threads. Further, a hand grip 204 may be positioned over the elongated body 1 and/or sleeve 5 to provide a convenient gripping portion during use, e.g. during placement of the ballmark repair tool 20 over a ballmark or the like. A cap 202 may be secured above the handgrip 204. In particular embodiments, the cap is constructed of PVC or the like.

Figure 3:
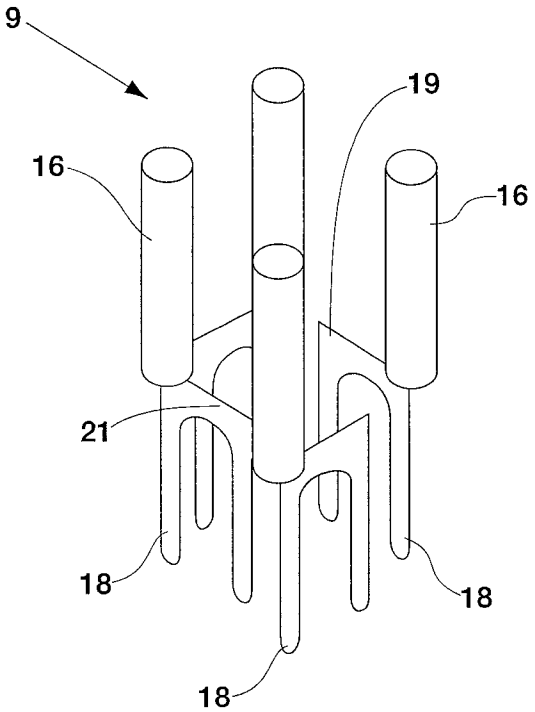
FIG. 3 is an isolated, side-perspective view of a prong assembly of FIG. 1, with elements removed for clarity.

FIG. 3 shows one embodiment of an isolated prong assembly 9 having a plurality of blade units 18. As shown, one example includes four blade units (with one blade unit hidden from view) that are typically positioned perpendicular to the planar prong support face 19. Linkages 21 secure the pair of blades in each blade unit 18 as discussed hereinafter. The prong extensions 16 extend away from the blade units 18 and may be cylindrical, or include sleeves or the like, for ease of rotation within the prong apertures.

Figure 4:
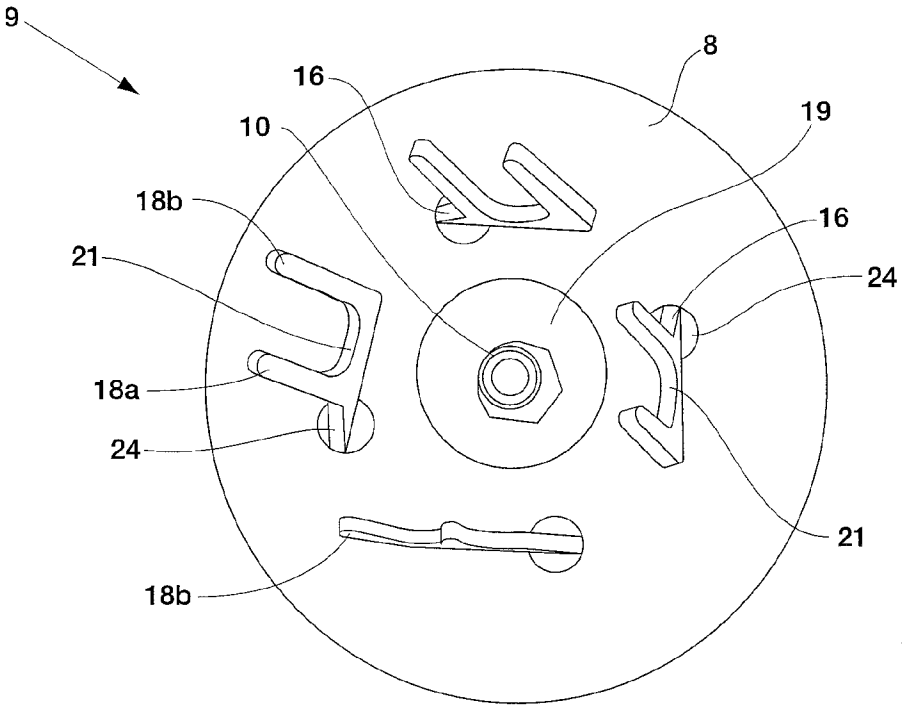
FIG. 4 is an isolated, bottom-perspective view of a prong assembly of FIG. 1 in a first entry position.

FIG. 4 shows an isolated view of the prong assembly 9 in a first entry position, e.g. substantially perpendicular entry into the surface of a putting green. As shown, the blade units 18 in this first entry position are generally sized and patterned around the periphery of a ballmark. Each blade unit may include a first proximate blade 18*a* and a second distal blade 18*b*. Typically, the first proximate blade 18*a* is translationally fixed about one point to the prong assembly. For instance, as shown in FIG. 4, the first proximate blade 18*a* may have an opposing prong extension 16 that protrudes through the entry 24 on the lower face of the housing 8 to the gear assembly. A fastener nut 10 is shown securing the lower portion of the housing 8 and prong assembly to the elongated body assembly above.

Figure 5:
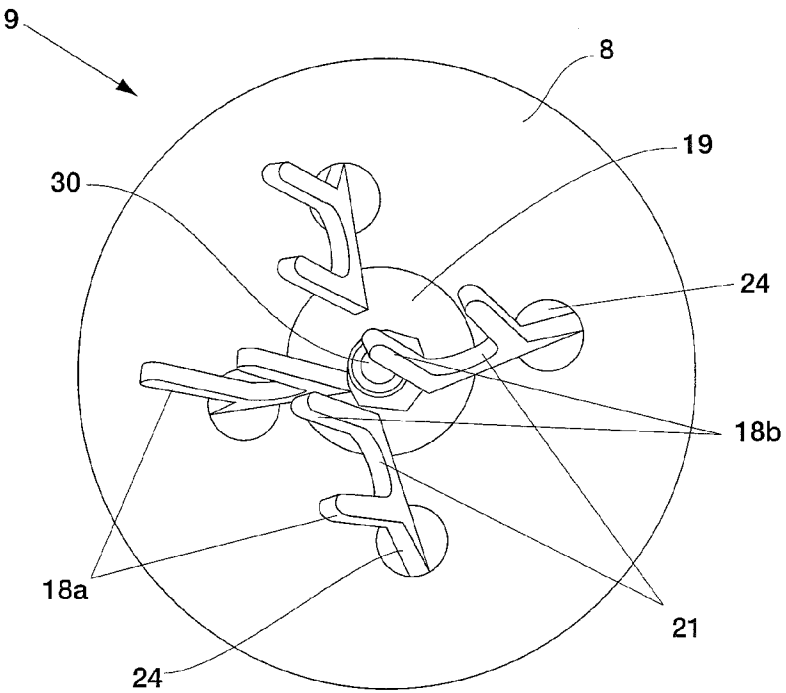
FIG. 5 is an isolated, bottom-perspective view of a prong assembly of FIG. 1 in a second twisted position.

FIG. 5 shows an isolated view of the prong assembly 9 in a second twisted position, e.g. the blade units are twisted substantially ninety degrees. For instance, the face of the proximate blade 18*a* may remain in place relative to entry 24, but twists substantially ninety degrees in place. In other examples, the face of the proximate blade 18*a* may remain in place, but twists greater than about ninety degrees to meet a particular ballmark repair application. The distal blade 18*b* may rotate, i.e. translate, across the lower face of the housing and/or prong assembly to this second twisted position. As shown, each of distal blades 18*b* have twisted substantially ninety degrees to simulate the proper repair motion of a ballmark, e.g. a gentle twisting motion to uniformly repair a ballmark.

In particular embodiments of the handle assembly 30, the handle transfers the rotation movement from the upper turning portion to the lower, ground-engaging prong assembly. In some examples, the turning portion 2 of the handle assembly 30 may rotate about one hundred and thirty five degrees counter-clockwise. The turning portion, i.e. the knob, handle or the like, allows only an isolated pre-determined movement. For instance, a setscrew 11 limits travel of the turning portion, so that the tool will be at proper positions for start and finish of rotation. Therefore, the handle assembly transfers a consistent, uniform rotation to the blade units for a consistent, uniform repair of a ballmark. However, other examples include a series of partial pre-determined movements, i.e. greater or less than one hundred and thirty five degrees rotation, for an intended blade unit rotation for a particular ballmark repair application.

In use, the prong assembly and outer sleeve 5 are presented in the first entry position as introduced herein. The blade units 18 together define an outer periphery of a ballmark. Each of the blade units 18 include the linkage 21 that connect the individual prongs. The housing 8 generally houses the inner gear assembly that facilitates the movement of the individual blade units 18 through the entry 24 on the lower face of the housing 8.

In an alterative embodiment, the individual blade units of the twistable prong assembly 9 rotate substantially ninety degrees to repair the ballmark 102 to remove the guesswork and produce uniformity of a mark repair. After the twisting motion of the ballmark repair tool, the user pulls the prong assembly 9 out of the putting green 100 surface and typically taps, and/or steps, on the putting green 100 around the previous ballmark 102 for optimum repair. The result is a device and method of using the device for proper ballmark repair on a putting green or the like, for instance the device reduces, or even eliminates, a variety of hand/eye judgments, including: where to insert the traditional spade tools; how many places to have to enter the green around the ballmark; how to turn the spades; or how to lift the turf, sod or the like for proper repair.

In such examples, the prong assembly 9 is generally sized to fit the boundary of a golf-ball sized ballmark on a putting green, e.g. as indicated by the golf ball shown in the dotted environment. The prong assembly 9 includes a plurality of twistable blade units 18 protruding through housing 8. The blade units are perpendicular to the prong assembly 9 in the first entry position and also throughout the twisting motion discussed and shown hereinafter. The blade units 18 can be constructed of a variety of shapes, styles and sizes for the convenience of its user. Typically, the blade units 18 include rigid and/or sharp distal ends to protrude through the surface of the green.

Further, the top portion of the blade units may include prong extensions 16, which generally protrude through the housing and are fastened to the gear assembly. The prong extensions 16 may protrude through the prong apertures 17 of the lower portion of the housing 8. Other examples include a variety of aperture and housing arrangements.

In particular, examples, each blade unit 18 includes two blade prongs separated by a linkage 21. Each linkage 21 between the blade prongs of each blade unit 18 may be a substantially horizontal element; however, other examples include a variety of linkage shapes and configurations.

The housing 8 is generally sized to house the prong assembly 9 from the mechanical movements and dirt/debris during use. The housing 8 may include a top cover 7 that is generally aligned and secured to the housing 8 with fasteners 15. In some examples, the fasteners 15 are head screws.

The prong assembly 9 is generally twistable, for instance twistable in substantially ninety degrees, with the twist assembly. However, in other examples the prong assembly is twistable in less than ninety degrees, as well as twistable in directions greater than ninety degrees. The twist assembly may include a plurality of planetary gears 13 surrounding a pinion gear 12. Typically, the pinion gear 12 engages each of the planetary gears 13, which thereby drive the rotation of the prong assembly 9. A fastener nut 10 may secure the lower portion of the prong assembly 9.

Typically, the planetary gears 13 are generally sized to fit within housing 8 and are secured in place with setscrews 14. In particular examples, there are four planetary gears 13 circumferentially surrounding the pinion gear 12; however, other examples include a variety of planetary gears in engagement of the pinion gear 12 to twist the prong assembly 9. A coupling 6 may be secured one end to the elongated body 1 and be engaged to the pinion gear 12 on the opposing end. For instance, the coupling 8 may include a setscrew 14, threads or other fastening means to secure to the lower end of the housing 5. The opposing end of the coupling 6 may be positioned on the pinion gear 12 to couple rotation of the turning portion 2 and the prong assembly 9. In exemplary embodiments, the coupling 8 allows the user to twist the prong assembly 9 substantially ninety degrees in a single twisting motion of the turning portion 2. Those of ordinary skill in the art having the benefit of this disclosure will appreciate that there are other examples of coupling the turning portion 2 and the prong assembly 9 to create the substantially ninety degrees twisting motion to best repair a ballmark.

In one example, the elongated body 1 is generally affixed to the housing 8 and prong assembly 9 with a pair of opposed threaded ends. The elongated body 1 may include a threaded upper end 42 and a threaded lower end 40. In particular examples, the threaded upper end 42 includes male threads and the threaded lower end 40 also includes male threads. The threaded upper end 42 may protrude through a control disk 2 to receive and retain a knob 2. The threaded lower end 40 may protrude through the sleeve 5 be secured to the coupling 6.

In other embodiments, the inventions include a ballmark repair kit. In this embodiment, the kit may comprise a twistable prong assembly, e.g. any of the planetary gears and pinion gears of the gear assemblies previously shown or described. The kit may further include a plurality of blade units, e.g. any of the blade units shown or described, including but not limited to, replacement blade units. Further, the kit may include a handle assembly, e.g. any of the turning portions and/or elongated bodies shown or described.

In use, the ballmark repair tool 20 allows the operator, inter alia, to remain standing when repairing a ballmark 102 on a putting green 100. In particular methods, the operator places the ballmark repair tool 20 over the center of the ballmark 102 and presses the four, two-prong prong assembly in the putting green 100. In the first entry position, the blade units 18 form a square. In one example, the cross-section of the square is about one-quarter inch greater than the diameter of a golf ball. Next, the operator turns the turning portion 2 of the handle assembly 30. In one example, the operator turns the turning portion 2 about one hundred and thirty five degrees counter-clockwise. However, those of ordinary skill in the art having this disclosure will recognize that greater or lesser degrees of rotation may be beneficial for a particular repair application. Turning the portion 2 rotates the pinion gear 12. Typically, a setscrew 11 limits travel of the turning portion, so that the tool will be at proper positions for start and finish of rotation. The pinion gear 12 turns the plurality of planetary gears 13, and thereby the prong assembly, e.g. the blade units 18, turn about ninety degrees clockwise. However, those of ordinary skill in the art having this disclosure will recognize that greater or lesser degrees of twisting of the blade units may be beneficial for a particular repair application. Finally, the operator pulls the prong assembly 9 vertically out of the putting green surface 100 and may then step, or otherwise tap with a putter, the area, thereby uniformly and properly repairing the ballmark 102.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

We claim:

1. A ballmark repair tool for repairing a ballmark on a putting green comprising:

(a) a handle assembly having a turning portion positioned on a proximate end of an elongated body and connected to a pinion gear on its opposing distal end; and (b) a twistable prong assembly positioned on said distal end of said elongated body and in communication with said turning portion, wherein said twistable prong assembly includes a plurality of ground-engaging blade units each attached to a planetary gear centered around said pinion gear and having at least one proximate blade and at least one distal blade, and wherein said turning portion rotates said proximate blade substantially ninety degrees in a stationary position and traverses said distal blade across said twistable prong assembly.

2. The device of claim 1, wherein said blade units remain perpendicular to said ballmark during twisting.

3. The device of claim 1, including a linkage between said proximate blade and said distal blade.

4. The device of claim 1, wherein said proximate blade includes a face adapted to rotate substantially ninety degrees.

5. The device of claim 1, wherein said distal blade is adapted to transverse substantially ninety degrees across said twistable prong assembly.

6. The device of claim 1, wherein said turning portion includes a handgrip.

7. The device of claim 1, wherein said turning portion rotates about one hundred and thirty degrees counter-clockwise.

8. The device of claim 7, wherein said turning portion includes a set pin to limit travel.

9. The device of claim 1, wherein said turning portion is substantially perpendicular to said twistable prong assembly and adapted to twist said prong assembly substantially ninety degrees in a single motion.

10. The device of claim 1, including a sleeve, a cavity adapted to receive said elongated body and a threaded upper end adapted to engage said handle assembly.

11. In a ball mark repair tool having a handle and prong assembly with a plurality of ground-engaging blade units with opposing prong extensions, a twist assembly comprising:

(a) a plurality of planetary gears in connection with said prong assembly, wherein said planetary gears rotate said prong extensions; and (b) a pinion gear in communication with said handle and engaged with said planetary gears, wherein said pinion gear rotates said plurality of planetary gears to twist said prong assembly substantially ninety degrees, each ground engaging blade unit having at least one proximate blade and at least one distal blade, and wherein a turning portion rotates said proximate blade substantially ninety degrees in a stationary position and traverses said distal blade across said twist assembly, and wherein said pinion gear is centered about said plurality of planetary gears.

12. The assembly of claim 11, wherein said plurality of planetary gears include four planetary gears surrounding said pinion gear.

13. The assembly of claim 11, including a housing to house said plurality of planetary gears and pinion gears, wherein said housing including a top opening, a cavity and a plurality of prong apertures adapted to receive said prong assembly.

14. The assembly of claim 11, further including a coupling to engage said pinion gear and adapted to couple the rotation of said turning portion and said prong assembly.

15. The assembly of claim 14, wherein said coupling is adapted to couple the rotation of said turning portion and said prong assembly in a single motion.

16. The assembly of claim 14, including a setscrew to said coupling.

17. A ballmark repair tool for repairing a ballmark on a putting green comprising:

(a) a handle assembly having a turning portion positioned on a proximate end of an elongated body and connected to a pinion gear on its opposing end;

(b) a twistable prong assembly positioned on a distal end of said elongated body and in communication with said turning portion, wherein said pinion gear being centered about a plurality of planetary gears, and said pinion gear engages each of said planetary gears; and (c) a plurality of ground-engaging blade units having at least one proximate blade and at least one distal blade, and wherein said turning portion rotates said proximate blade substantially ninety degrees and traverses said distal blade substantially ninety degrees across said twistable prong assembly.

* * * * *

UNITED STATES PATENT AND TRADEMARK OFFICE

CERTIFICATE OF CORRECTION

PATENT NO. : 8,920,265 B1
APPLICATION NO. : 13/752715
DATED : December 30, 2014
INVENTOR(S) : Jones It is certified that error appears in the above-identified patent and that said Letters Patent is hereby corrected as shown below:

In The Specification

In Column 4, line 67, twist assembly should read “prong assembly”

In column 9, line 8, ball mark should read “ballmark”

Signed and Sealed this
Seventh Day of April, 2015

Michelle K. Lee

Michelle K. Lee
*Director of the United States Patent and Trademark Office*